US005502468A

United States Patent [19]

Knierim

[11] Patent Number: 5,502,468

[45] Date of Patent: Mar. 26, 1996

[54] INK JET PRINT HEAD DRIVE WITH NORMALIZATION

[75] Inventor: David L. Knierim, Wilsonville, Oreg.

[73] Assignee: Tektronix, Inc., Wilsonville, Oreg.

[21] Appl. No.: 997,003

[22] Filed: Dec. 28, 1992

[51] Int. Cl.[6] ..... B41J 2/01

[52] U.S. Cl. ..... 347/19; 347/43

[58] Field of Search ..... 346/1.1, 140 R; 358/502, 518; 310/316, 317; 347/19, 43, 9, 14, 13, 12

[56] References Cited

U.S. PATENT DOCUMENTS

| | | | |
|---|---|---|---|
| 4,266,232 | 5/1981 | Juliana, Jr. et al. | 346/140 R |
| 5,038,208 | 8/1991 | Ichikawa et al. | 346/1.1 X |
| 5,095,256 | 3/1992 | Ueyama et al. | 310/316 X |
| 5,124,716 | 6/1992 | Roy et al. | 346/1.1 |
| 5,155,498 | 10/1992 | Roy et al. | 346/1.1 |
| 5,170,177 | 12/1992 | Stanley et al. | 346/1.1 |
| 5,212,497 | 5/1993 | Stanley et al. | 346/1.1 |
| 5,250,956 | 10/1993 | Haselby et al. | 346/1.1 |
| 5,353,052 | 10/1994 | Suzuki et al. | 347/19 |

FOREIGN PATENT DOCUMENTS 4-028556 1/1992 Japan .

OTHER PUBLICATIONS

Supertex Inc. Databook 1991–1992, 32–Channel Gray–Shade Display Column Driver, Device HV38.

*Primary Examiner*—Benjamin R. Fuller
*Assistant Examiner*—Alrick Bobb
*Attorney, Agent, or Firm*—Ralph D'Alessandro; John Smith-Hill

[57] ABSTRACT

A method of normalizing performance of an image forming marking element, the method comprising the steps of operating the marking element with an adjustable operating parameter set to a first test value and quantifying a first value of a quantifiable performance characteristic of the marking element, operating the marking element with the operating parameter set to a second test value and quantifying a second value of the quantifiable performance characteristic, calculating an optimum value of the operating parameter, and adjusting the operating parameter to its calculated optimum value.

38 Claims, 4 Drawing Sheets

INK JET PRINT HEAD DRIVE WITH NORMALIZATION

FIELD OF INVENTION

This invention relates to ink jet printers and, more specifically, to normalizing the ink jets of a multi-orificed ink jet print head in order to obtain optimum performance from each jet of the print head.

BACKGROUND OF THE INVENTION

U.S. Pat. No. 5,124,716, the disclosure of which is hereby incorporated by reference herein, discloses a multi-orifice ink jet print head for ejecting ink drops onto a print medium, such as paper. The multi-orificed ink jet print head 25 is shown with associated elements in FIG. 1. An acoustic driver, such as a piezoelectric transducer 32, is coupled to a diaphragm 34 for ejecting ink drops from an ink chamber 12, through a nozzle orifice 18, and onto a print medium 19. The piezoelectric transducer 32 comprises first and second conductive electrodes separated by a layer of insulating piezoelectric material. A control signal provided by a signal source 56 is applied to the transducer and the diaphragm 34 is displaced according to the voltage of the control signal.

FIG. 2 shows a known unnormalized waveform of a control signal that may be provided by the signal source 56 for driving the piezoelectric transducer 32. The signal has a positive pulse of +Vo volts which lasts for about 5 μs and then returns to 0 volts. The signal remains at 0 volts for a period of time T1. A negative pulse of −Vo volts, follows the period T1 and lasts for a second period T2 before returning to 0 volts. During the positive pulse, the piezoelectric transducer displaces the diaphragm away from the cavity interior, and ink from reservoir 14 is drawn into the cavity 12. In response to the negative pulse, the diaphragm is displaced for compressing the cavity and an ink drop is ejected from the orifice 18 onto the print medium 19.

When placing an image on the print medium, the print head 25 shuttles back and forth along the X-axis parallel to the plane of the print medium surface and the print medium advances along the Y-axis perpendicular to the X-axis while the jets of the print head eject drops onto the print medium. The quality of the resulting image depends upon the size and velocity of the drops produced by each jet of the array of jets of the print head. Drop size affects the color density of an image while velocity affects the placement of dots with respect to other dots in the image. Ideally, each jet of the print head performs similarly to the other jets of the print head and each print head is manufactured with optimum parameters for ejecting ink. However, because of limited controls during manufacturing, performance variations exist.

Many parameters affect the performance of ink jets. Temperature non-uniformities across a print head will produce variations in ink viscosity for the different jets of the print head. Drop production is affected by driver efficiency, which changes according to parameters such as thickness of the layer of piezoelectric material, stiffness of the diaphragm and the piezoelectric material, density and piezoelectric constant of the piezoelectric material and coupling coefficient between the electrodes and the piezoelectric material. Alignment of the acoustic driver with respect to the ink jet chamber and the coupling interface between the acoustic driver and the diaphragm of the ink chamber also affect drop production. Because of the limited control over these and other ink jet parameters, production lots experience variations in jet performance. By adjusting the waveform of the control signal applied to the acoustic driver, drop size and/or velocity may be altered and variations in jet performance may be partially compensated.

It is known from U.S. Pat. No. 5,124,716 to adjust the waveform of the control signal by changing the timing intervals, T1 and T2 of FIG. 2.

U.S. Pat. No. 5,212,497 which is assigned to the assignee of the present invention and the disclosure of which is hereby incorporated by reference herein, discloses a normalization technique wherein the drop ejection velocity of a jet is monitored by using a strobe imaging device to strobe ejected drops while adjusting the attenuation of the output signal provided by a signal source to produce the control signal applied to the jet's piezoelectric transducer. Referring to FIG. 3, changing the amplitude of the control signal $V_{cntrl}$ changes the amount by which the acoustic driver 32 displaces the diaphragm 34 of the ink jet and thus affects drop ejection velocity. The control signal received by the piezoelectric transducer is controlled by adjusting a potentiometer $R_{POT}$, which contributes to the series resistance ($R_{POT}$+$R_{SA}$) of a divider network 36. After adjusting the potentiometer for an optimum ejection velocity, the series resistance is measured and data representative of the optimum series resistance is recorded. This recorded data is sent to a resistor trim production step where the series resistor $R_{SA}$ of the resistor divider network 36 which is in the series path between the drive signal source 56 and the acoustic driver 32 is trimmed according to the received data. To produce a normalized print head in which each jet is tuned for uniform performance, the strobe imaging/potentiometer adjustment and the subsequent series resistor trim steps are performed for each jet of the print head. As such, the resistor trim normalization technique requires a significant amount of time for performing the normalization steps for all of the jets of the multiple-jet-array print head. In addition, the divider network dissipates power when attenuating the control signal and therefore consumes extra energy when used to attenuate the control signal and affect jet performance.

These problems are solved in the method and apparatus of the present invention.

SUMMARY OF THE INVENTION

According to a first aspect of the present invention, there is provided a method of normalizing performance of an image forming marking element having an adjustable operating parameter, wherein a quantifiable performance characteristic of the marking element depends on the value of the parameter. The method comprises the steps of operating the marking element with the operating parameter set to at least one test value and quantifying a value of said performance characteristic of the marking element, calculating a value of the operating parameter based on a desired value of said performance characteristic, said at least one test value of the operating parameter, and said value of the performance characteristic, and adjusting the operating parameter to its calculated value. This normalization may be done electronically or manually.

According to a second aspect of the present invention there is provided a method of characterizing relative performance characteristics of an array of at least two image forming marking elements, each having an adjustable operating parameter, which method comprises the steps of forming a test image with each marking element of the array with the operating parameter of each marking element set to at least one predetermined value, measuring a quality of each test image representative of each marking element, and quantifying a relative performance characteristic according to the differences in measured qualities between test images representative of the marking elements.

BRIEF DESCRIPTION OF THE DRAWINGS

For a better understanding of the invention, and to show how the same may be carried into effect, reference will now be made, by way of example, to the accompanying drawings, in which.

In the drawings, like reference numerals designate similar components.

DETAILED DESCRIPTION

Figure 1:
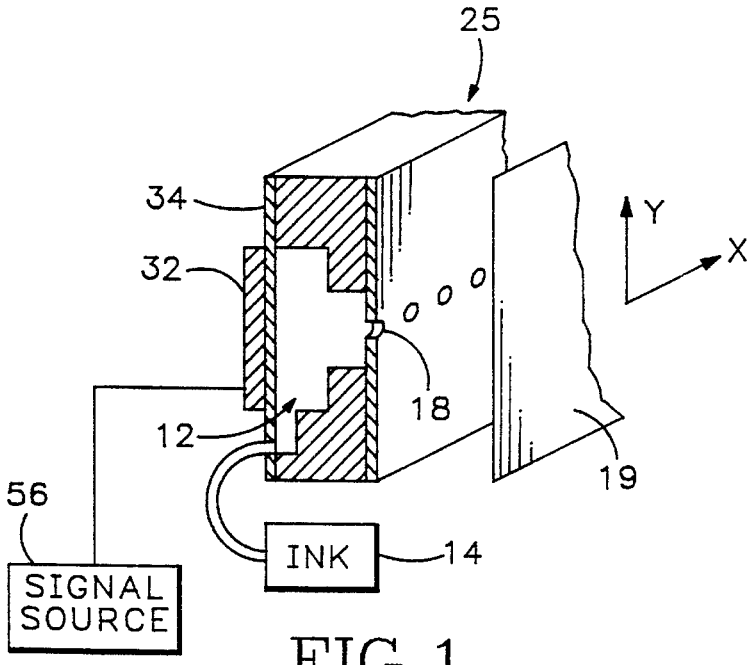
FIG. 1 PRIOR ART
FIG. 1 is a schematic fragmentary view of a known piezoelectric, acoustically driven, ink jet print head.
Figure 2:
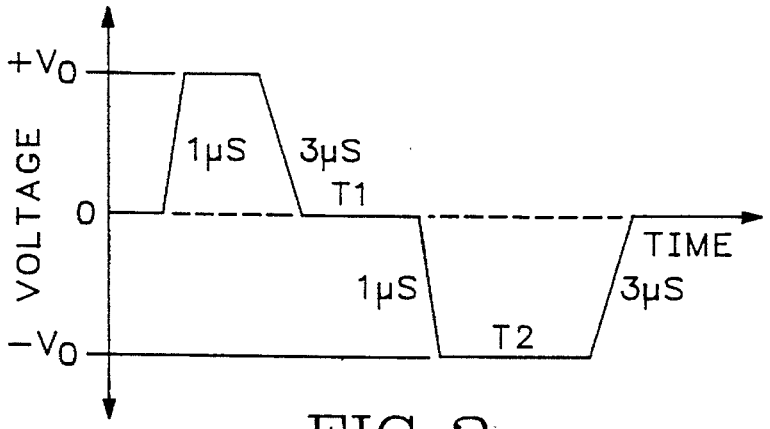
FIG. 2 PRIOR ART
FIG. 2 illustrates the waveform drive of the signal that may be used drive the ink jet print head of FIG. 1.
Figure 3:
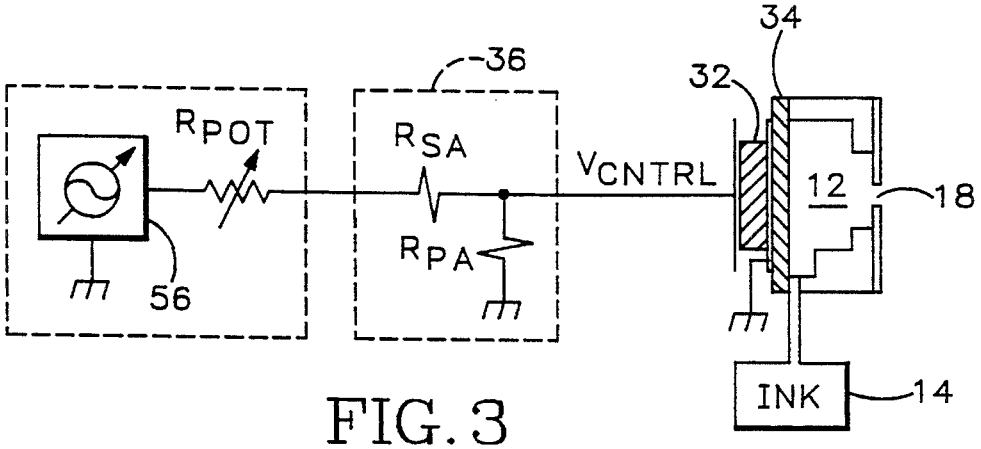
FIG. 3 PRIOR ART
FIG. 3 is a schematic view of a prior art ink jet normalization circuit.
Figure 4:
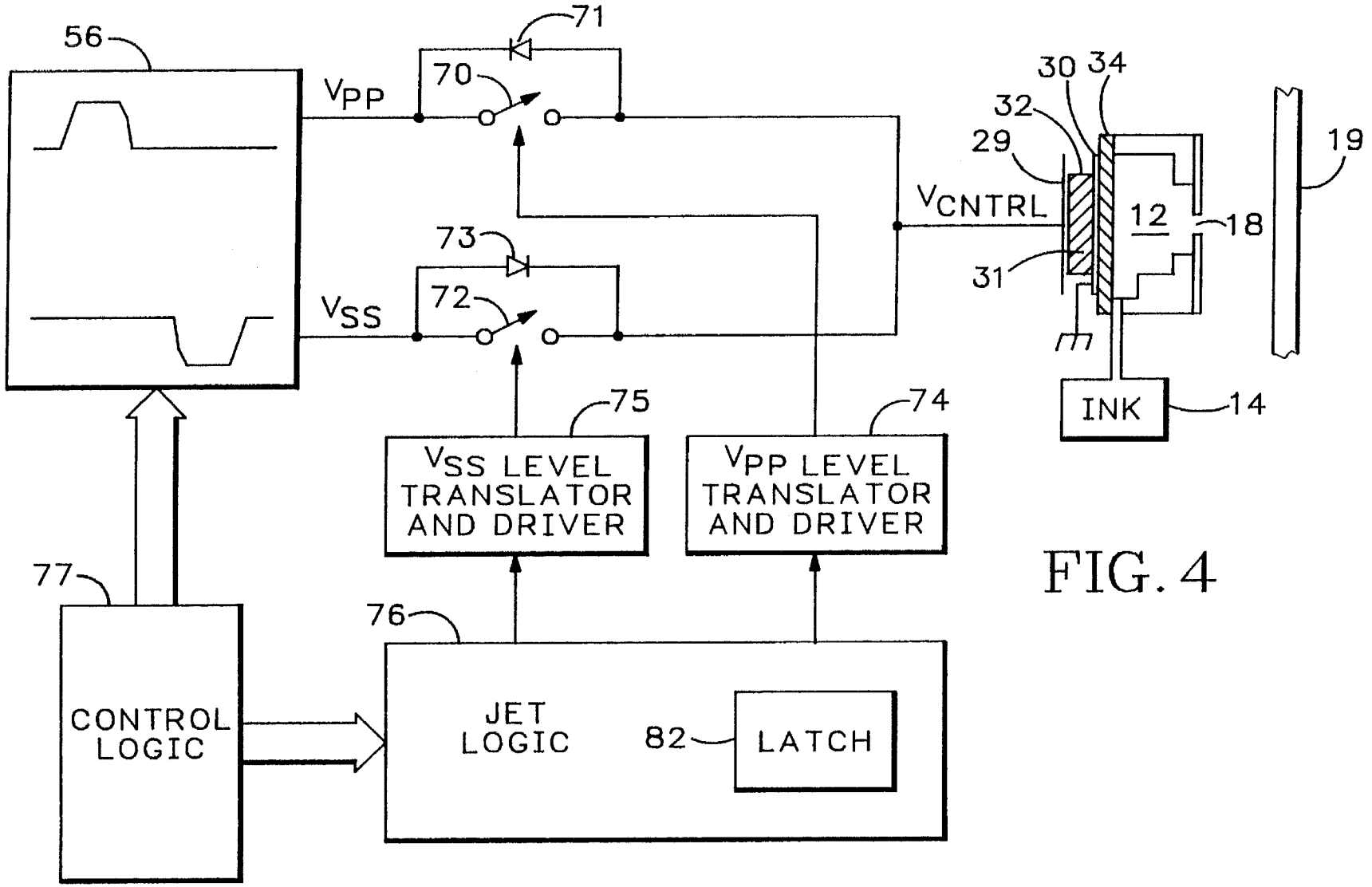
FIG. 4 is a schematic illustration of a programmable ink jet in accordance with the present invention.
Figure 5:
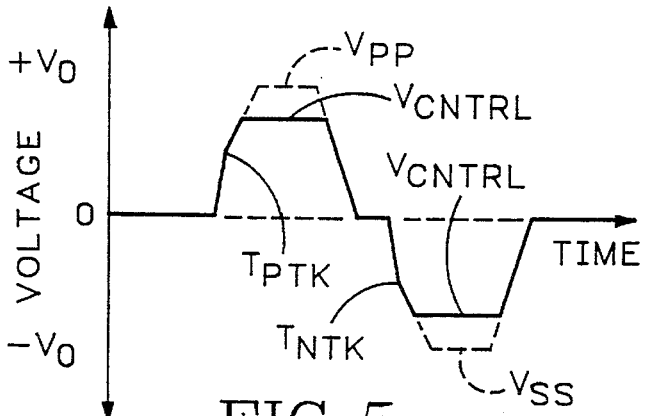
FIG. 5 illustrates the waveform of a drive signal associated with the programmable ink jet of FIG. 4.

FIG. 4 shows a signal source 56 generating two signals Vpp and Vss. Vpp is a positive going pulse train, with one pulse for each time any of the jets in the print head could need to eject ink. Vss is a negative going pulse train, with a single negative pulse following a fixed delay after the end of each positive Vpp pulse. There may be more than one signal source 56 block for a print head, but typically there are fewer signal sources 56 than there are jets since each signal source drives multiple jets within the head. For each jet, there is a FET switch 70 connecting Vpp to $V_{cntr}$ which drives the piezoelectric transducer 32 for that jet. There is also a FET switch 72 connecting Vss to $V_{cntr}$ for that jet. Diodes 71 and 73 are connected across FET switches 70 and 72 respectively. The FET switches 70 and 72 are controlled from jet logic 76 through level translators 74 and 75 respectively. The level translators convert the standard 0 to 5 volt logic levels from jet logic 76 to the appropriate levels for driving the gates of FET's 70 and 72. Latch 82 within jet logic 76 holds the normalization value in a memory location for that jet. Blocks 70 through 76 are replicated once for each jet. Finally, control logic 77 sends timing, sequencing, and data signals to signal source 56 and to control logic 77. There may be more than one control logic block 77 for a print head, but typically each control logic block 77 will drive multiple jet logic blocks 76 and therefore control multiple jets.

$V_{cntrl}$, the piezoelectric transducer driving voltage, for a given jet is controlled as follows: During the idle times between Vpp and Vss pulses, FET switch 72 is left on to keep $V_{cntrl}$ at zero volts. Since Vpp and Vss are both at zero volts in between pulses, either or both of the FET switches 70 and 72 could be turned on. (Even if neither of the FET switches 70 and 72 were on, $V_{cntrl}$ would remain near zero volts because of diodes 71 and 73.) If the jet is not to fire during a Vpp and Vss pulse pair, then FET switch 70 is kept off during the Vpp pulse and FET switch 72 is kept off during the Vss pulse. The opposite FET switch (72 during the Vpp pulse and 70 during the Vss pulse) may be turned on to help maintain zero volts on $V_{cntrl}$. If the jet is to fire during a Vpp and Vss pulse pair, then FET switch 72 is kept off during the Vpp pulse and FET switch 70 is kept off during the Vss pulse. FET switch 70 is turned on before the Vpp pulse starts and is turned off during the rising edge of the Vpp pulse. The turn-off time is a function of the value stored in latch 82 within jet logic 76. The larger the value in latch 82, the later FET switch 70 is turned off, and therefore the higher voltage on $V_{cntrl}$ at the time it is turned off. Since the piezoelectric transducer 32 presents a mostly capacitive load on $V_{cntrl}$, the voltage on $V_{cntrl}$ will substantially maintain the voltage it had at the time FET switch 70 turned off. As Vpp ramps back down to zero volts at the end of its pulse, diode 71 will conduct to pull $V_{cntrl}$ back down near zero. The Vss pulse is handled similarly. Before the start of the Vss pulse, FET switch 72 is turned on. It is turned off during the leading (falling) edge of the Vss pulse at a time determined by the value in latch 82. It should be noted that a different latch could be used if separate control of the positive and negative pulse amplitudes is required.

The larger the value in latch 82, the later FET switch 72 is turned off and, therefore, the lower (more negative) is the voltage on $V_{cntrl}$ at the time FET switch 72 is turned off. Again, this voltage is substantially maintained by the capacitive load until Vss ramps back up to zero. As Vss ramps back to zero, diode 73 conducts to ramp $V_{cntrl}$ back almost to zero.

The slope of each leading edge of each Vpp and Vss pulse decreases at a knee that occurs part way through the leading edge. This allows a given time resolution for turning off FET switches 70 and 72 to result in finer voltage resolution on $V_{cntrl}$.

Since each jet within a print head has its associated jet logic 76 and latch 82, each jet can be driven with a different $V_{cntrl}$ amplitude by storing different values in each of the latches 82. If the values stored in latches 82 are selected such that each jet performs close to an optimum operation point, then the print head can be normalized with this drive method.

When generating the normalization data, latches 82 are loaded with a predetermined test value or values, and the desired characteristics of the jet are measured. The best value, or an approximation of that value, for latch 82 for each jet is determined from the measured characteristics, and this data is stored in non-volatile memory within the printer or head. When the printer is operated, the data from this non-volatile memory is loaded into latches 82 to cause each jet to be driven with near its optimum voltage level. Alternatively, latches 82 could be the non-volatile memory avoiding the loading step each time the printer is turned on or used.

In one particular normalization mode, normalization is effected by adjusting dot size-to produce a desired color density. Color density may be measured by comparing the intensity of light reflected by a test image with the intensity of incident light. The intensity of light reflected by the print medium bearing the test image depends on the proportion of the area of the print medium that remains exposed. This proportion is dependent on the imaged pattern and characteristics of the printer. For a nominal 25% fill shown in FIG. 8, the desired actual test image area coverage is at least $\pi/8$ or about 39%.

Figure 6:
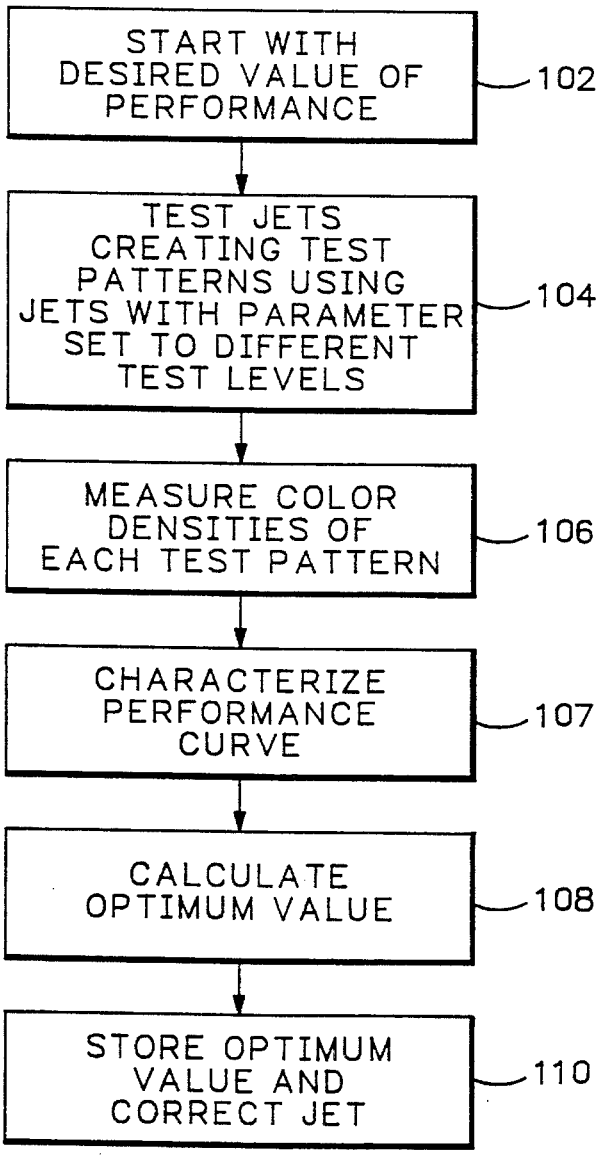
FIG. 6 is a flow chart representative of an aspect of the present invention.
Figure 7:
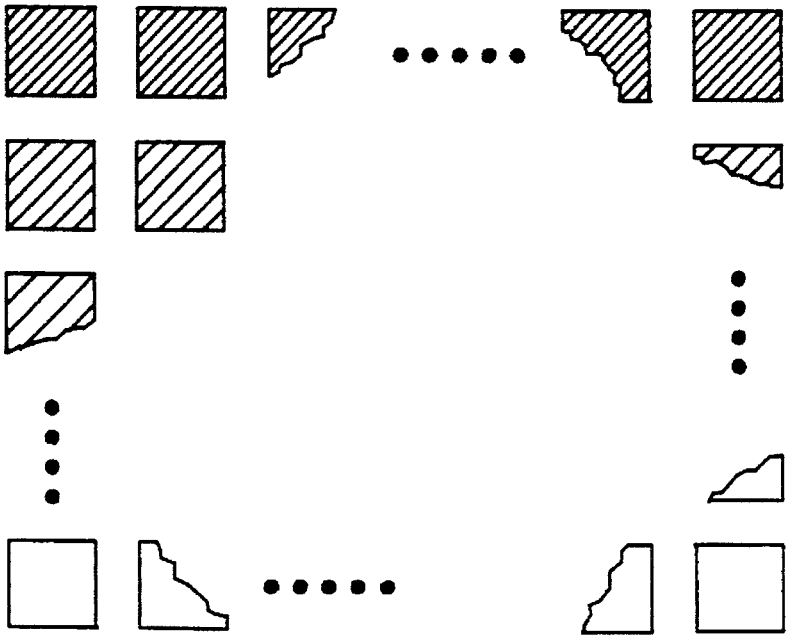
FIG. 7 illustrates an image test pattern corresponding to FIG. 6.

FIG. 6 shows a flow chart for explaining the one particular normalization mode. The normalization mode has a primary objective of normalizing the jet for ejecting ink drops of a given drop size, so that the jet provides a desired color density when used to produce an image on the print medium. In step 102, a desired color density is defined. In step 104, a servo controller simultaneously controls the position of the print head 25 and the printing medium 19 while ejecting drops from the different jets of the multi-jet-array print head onto the print medium in order to create the test images as shown in FIG. 7. The jets are each tested at various test control values during the production of these test images. A first set of test patterns is made with each jet set to a first test control value provided by a normalization controller (not shown), whereupon a new test control value is stored in each of the latches and a new set of test patterns is generated on the print medium. This may be repeated for third and fourth or more test control values, dependent upon the shape of the characteristic curve. When finished generating the test images, the print medium bears an array of test images wherein each test image represents one jet tested with its particular parameter set to a particular test control value.

Figure 8A:
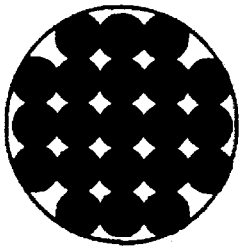
FIGS. 8*a*–8*c* show enlargements taken from of FIG. 7 representing different test values.
Figure 8B:
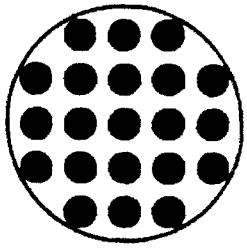
Figure 8C:
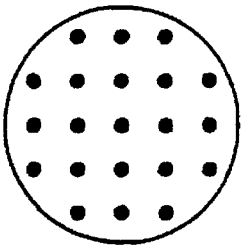

Enlarged views of FIG. 7 are shown in FIGS. 8*a*, 8*b* and 8c. When the ink drops are the correct size, FIG. 8*b*, they occupy the desired percentage of the area of the test image. When the ink drops ejected by the jet are too large, FIG. 8*a*, the dots occupy a greater proportion of the test image area and the test image produces a low intensity of reflected light. When the drops are too small, FIG. 8*c*, the dots occupy a lesser proportion of the test image area and the intensity of light reflected is higher.

The different test control values used during normalization can cover a sufficient range that at least one test image has a fill ratio greater than the desired percentage and at least one has a fill ratio less than the desired percentage.

In step 106, each test image of the print medium is examined by an optical scanning device, for example a Hewlett-Packard Scanner Jet IIc scanner or a JX 450 scanner from Sharp Electronics, Inc., for obtaining its color density. The color density is determined according to a reflection index, which is a ratio of an average reflected light intensity received from the test image in proportion to an incident light intensity as projected onto the test image. A characteristic curve is then derived in step 107 which defines a "color density versus test control value" relationship.

In step 108, an optimum control value is determined for each jet according to the characteristic curve, the test results, test control values of the jet and the desired image color density specified in step 102.

After calculating the optimum control value for each jet of the multiple-jet-array print head, the optimum control values are written (in step 110) into previously assigned non-volatile memory locations of, for example, a printer controller (not shown), by an appropriate apparatus, such as a CPU (not shown). In subsequent operation of the print head, the optimum control values are read from the memory array and the control latch 82 of each jet is loaded with its optimum control value. With the print head thus normalized, the ink jet printer will produce images of substantially ideal color density.

In a modification of the normalization method described with reference to FIG. 6, a nominal performance curve for a nominal jet may be obtained by collecting a number of test data points, from a number of different jets, from a number of different manufacturing lots, which are tested over a wide range of test control values. The nominal curve is generated from a greater number of control values than would normally be used afterwards for normalizing a single jet as described with reference to FIG. 6. The nominal curve may then be adapted to each particular jet by using a scaling factor. The scaling factor is obtained according to the unique test results of each jet tested at the given test control values. In a normalization procedure for an individual jet, the number of test control values used is only that which is necessary for obtaining the scaling factor and might be only two or three, or could be as few as one. Having obtained the scaling factor, the nominal curve is then scaled to produce a characteristic curve for the particular jet. An optimum control value that produces the desired image color density is then obtained using this characteristic curve for the individual jet. If necessary, an offset could be employed in place of or in conjunction with the scaling factor.

As a modification of this characteristic curve technique, a mathematical relationship can be used for characterizing the "color density versus control test value" relationship. The mathematical relationship may be a polynomial equation with the order of the polynomial being less than the number of test control values used during normalization, even as simple as a linear equation, from which the optimum control value would be extrapolated or interpolated. The coefficients taken from either the simple linear equation or the polynomial equation characterize the tested jets.

It will be appreciated that the invention is not restricted to the particular embodiments that have been described, and that variations may be made therein without departing from the scope of the invention as defined in the appended claims and equivalents thereof. For example, the jet might be tested by ejecting an ink drop and making a measurement of the projection path of the ejected ink drop. The jet's projection path would be tested according to different control test values. Based on the test results, an optimum control value would be calculated for providing an optimum ink drop projection path.

Measurements need not be limited to quantifying parameters of a printed image on a print medium. The measurement might employ the strobe technique as used in the resistor trim normalization method described above to collect at least one performance characteristic value of the image forming marking element when driven at least one test control value. Further, the strobe technique described above could also be used in its entirety to determine the necessary drive voltage for each jet to obtain the desired performance characteristics. The drive voltage is then used to determine the control values to feed to the multiplicity of latches 82 to normalize the performance of the print head.

Desired control or drive voltages can also be obtained by scanning the optical density of the test image. These voltages can then be used to calculate the required resistances to laser trim the resistors integral to print heads, such as those utilized in the Phaser III color printers sold by Tektronix, Inc.

It is to be understood that the adjustable operating parameters discussed herein with regard to controlling the normalization of a print head include, but are not limited to, voltage, pulse width, delay time between pulses, and the rise and fall time of the pulses. The method can also be used to adjust more than one of these parameters by generating test images, for example, with each parameter independently varied while the others remain constant. It is also to be understood that the quantifiable parameters discussed herein for controlling the print head normalization can include, but are not limited to, dot size, drop size, ejection velocity, drop time to target or receiving medium, dot placement, optical density, drop break off time, variation of drop size or velocity as a function of drop ejection frequency, peak negative pressure within the jet, PZT diaphragm deflection and ink meniscus resonance amplitude.

In the case of the embodiment described with reference to FIG. 4, time at which the FET switches 70 and 72 turn off need not be a linear function of the data value in latch 82. The latch value to turn-off time function could be modified to compensate for non-linearities in the leading edge ramp of Vss and Vpp, and/or for non linearities in the ink jet performance curve.

While the invention has been described above with references to the specific embodiments thereof, it is apparent that many changes, modifications and variations in the materials, arrangements of parts and steps can be made without departing from the inventive concept disclosed herein. For example, the invention is not limited to the marking element being an ink jet, but is applicable also to the marking element for a bubble-jet printer, thermal transfer wax printer, or a dot matrix printer. Normalization also might involve determining different optimum control values for the positive and negative pulses, in which case the latch 82 could be used for positive pulses and a different latch (not shown) could be used for negative pulses.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A method of normalizing performance of individual ink jets in an ink jet printing apparatus that comprises a print head having a plurality of ink jets each having an operating parameter, wherein a quantifiable performance characteristic of each of said ink jets depends on a value of the parameter, and the operating parameter of each of said ink jets is adjustable independently of the operating parameter of another ink jet, said method comprising the steps of:

(a) selecting a first ink jet;

(b) operating the selected ink jet with the operating parameter of the ink jet set to a first test value and quantifying a first corresponding value of said performance characteristic of the selected ink jet;

(c) operating the selected ink jet with the operating parameter of the ink jet set to a second test value and quantifying a second corresponding value of said performance characteristic of the selected ink jet;

(d) calculating a value of the operating parameter for the selected ink jet based on a desired value of said performance characteristic of the selected ink jet, said first test value and said second test value of the operating parameter of the selected ink jet, and said first corresponding value and said second corresponding value of the performance characteristic of the first ink jet;

(e) adjusting the operating parameter of the selected ink jet to said calculated value;

(f) selecting a second ink jet; and (g) repeating steps (b)–(e).

2. A method according to claim 1, wherein step (b) comprises employing the selected ink jet to form a test image within a test area on a print medium and measuring a characteristic of the test image.

3. A method according to claim 1, comprising repeating steps (a)–(d) for each of the plurality of ink jets of the ink jet printing apparatus.

4. A method according to claim 2, wherein step (b) comprises employing the selected ink jet in the print head to apply a marking medium of a predetermined color to form a test image within the test area on the print medium and measuring color density of the test image.

5. A method according to claim 1, comprising, between steps (d) and (e):

assigning a memory location to the selected ink jet;

writing correction data representative of said calculated value of the operating parameter into the memory location; and employing the correction data in said memory location to adjust the operating parameter.

6. A method according to claim 5, wherein the step of employing the correction data includes reading the correction data from said memory location.

7. A method of normalizing performance of an image forming marking element having an adjustable operating parameter, wherein a quantifiable performance characteristic of the marking element depends on a value of the parameter, said method comprising the steps of:

(a) operating the marking element with the operating parameter set to a first test value and quantifying a first corresponding value of said performance characteristic of the marking element;

(b) operating the marking element with the operating parameter set to a second test value and quantifying a second corresponding value of said performance characteristic of the marking element;

(c) calculating a value of the operating parameter based on a desired value of said performance characteristic, said first test value and said second test value of the operating parameter, and said first corresponding value and said second corresponding value of the performance characteristic; and (d) adjusting the operating parameter to said calculated value, wherein step (a) comprises employing the marking element to apply a marking medium of a predetermined color to form a test image within a test area on a print medium and measuring color density of the test image.

8. A method according to claim 7, wherein the step of quantifying a performance characteristic of the marking element comprises:

illuminating the test area with incident light;

measuring the intensity with which light is reflected by the test area; and calculating said color density according to the intensity ratio of the reflected light and said incident light.

9. A method according to claim 7, comprising, between steps (c) and (d):

assigning a memory location to the marking element;

writing correction data representative of said calculated value of the operating parameter into the memory location; and employing the correction data in said memory location to adjust the operating parameter.

10. A method according to claim 9, wherein the step of employing the correction data includes reading the correction data from said memory location.

11. A method according to claim 7, wherein step (a) comprises:

storing a control value;

receiving a drive source signal from a signal source;

generating a stored control signal by processing the drive source signal according to the control value; and controlling said operating parameter of the marking element according to said control signal.

12. A method according to claim 11, wherein said marking element is a jet of an ink jet print head and wherein the controlling step comprises applying said control signal to a driving means of the jet, whereby the jet ejects fluid according to said control signal.

13. A method of normalizing performance of individual jets of an ink jet printer that comprises an ink jet print head including a plurality of ink jets each having an operating parameter, wherein a quantifiable performance characteristic of each of said ink jets depends on a value of the operating parameter for each of said ink jets and the operating parameter of each of said ink jets is adjustable independently of the operating parameter of another ink jet, said method comprising the steps of:

(a) selecting a first ink jet of the ink jet print head;

(b) (i) storing a control value for the selected jet, (ii) receiving a drive source signal comprising a first pulse having a first transition from a first voltage level to a peak voltage, a flat peak voltage from the end of the first transition, and a second transition from the peak voltage to the first voltage level, (iii) producing a control signal equal to or less than the drive source signal and producing said control signal at a voltage level corresponding to said control value, (iv) applying said control signal to a driving means of the selected jet, whereby the selected jet ejects fluid according to said control signal, and (v) quantifying a corresponding value of said performance characteristic of the selected jet;

(c) calculating a value of the operating parameter for the selected jet based on a desired value of said performance characteristic of the selected jet, said control value for the selected jet, and said corresponding value of the performance characteristic for the selected jet;

(d) adjusting the operating parameter for the selected jet to said calculated value;

(e) selecting a second ink jet of the ink jet print head; and (f) repeating steps (a)–(d).

14. A method according to claim 13, wherein the drive source signal further comprises a second pulse of opposite polarity to the first pulse and having a first transition from said first voltage level to an opposite polarity peak voltage, a flat peak voltage from the end of the first transition, and a second transition from the opposite polarity peak voltage to said first voltage level.

15. A method of characterizing relative performance characteristics of different ink jets of an ink jet print head having a plurality of ink jets, each of said ink jets having an operating parameter and the operating parameter of each of said ink jets being adjustable independently of the operating parameter of another ink jet, said method comprising the steps of:

(a) printing a first test image on a print medium with each of said ink jets with the operating parameter of each of said ink jets set to a first predetermined value;

(b) printing a second test image on a print medium with each of said ink jets with the operating parameter of each of said ink jets set to a second predetermined value;

(c) measuring a quality of the first test image representative of each of said ink jets;

(d) measuring a quality of the second test image representative of each of said ink jets; and (e) quantifying a relative performance characteristic according to differences in measured qualities between test images representative of the ink jets.

16. A method according to claim 15, wherein each ink jet has a cavity bounded by a diaphragm and a driver for displacing the diaphragm relative to said cavity in proportion to a magnitude of a control signal, and step (a) comprises for each ink jet:

(1) loading said predetermined value into a control means for controlling the plurality of ink jets;

(2) receiving a drive source signal from a signal source having at least a first pulse;

(3) producing said control signal having a voltage magnitude equal to or less than the received drive source signal and having a voltage magnitude representative of said predetermined value; and (4) applying said control signal to said driver.

17. A method of characterizing relative performance characteristics of an array of at least two image forming marking elements, each having an adjustable operating parameter, said method comprising the steps of:

(a) printing a first test image on a print medium with each marking element of the array with the operating parameter of each marking element set to a first predetermined value;

(b) printing a second test image on a print medium with each marking element of the array with the operating parameter of each marking element set to a second predetermined value;

(c) measuring a quality of the first test image representative of each marking element;

(d) measuring a quality of the second test image representative of each marking element; and (e) quantifying a relative performance characteristic according to differences in measured qualities between test images representative of the marking elements, and wherein step (b) and (c) comprise:

illuminating the test image with incident light;

measuring intensity of reflected light produced by the test image; and calculating color density as said quality of the test image according to the intensity ratio of the reflected light and the incident light.

18. A method of characterizing individual ink jets in an ink jet printing apparatus that comprises an ink jet head having a plurality of ink jets each having an operating parameter, wherein a quantifiable performance characteristic of each of said ink jets depends on a value of the operating parameter and the operating parameter of each of said ink jets is adjustable independently of the operating parameter of another ink jet, said method comprising the steps of:

(a) selecting a first ink jet;

(b) operating the selected ink jet with the operating parameter of the ink jet set to a first test value and quantifying a first value of said performance characteristic of the selected ink jet;

(c) repeating step (b) at least once with the operating parameter set to at least one other test value;

(d) determining a mathematical polynomial relationship between the quantified values of said performance characteristic for the selected ink jet and said test values wherein the order of the polynomial is less than the number of test values;

(e) characterizing said selected ink jet according to the coefficients of said polynomial for the selected ink jet;

(f) selecting a second ink jet; and (g) repeating steps (b)–(e).

19. A method of normalizing performance of individual ink jets in an ink jet printing apparatus having a plurality of ink jets each having at least a primary and a secondary operating parameter, wherein at least one quantifiable performance characteristic of each of said ink jets depends on values of the at least primary and secondary operating parameters and the at least primary and the secondary operating parameters of each of said ink jets are adjustable independently of the primary and secondary operating parameters of another ink jet, said method comprising the steps of:

(a) selecting a first ink jet;

(b) operating the selected ink jet with the at least primary and secondary operating parameters set to at least two sets of test values;

(c) determining values of the at least one quantifiable performance characteristic for each of the at least two sets of test values;

(d) calculating desired values of the at least primary and secondary operating parameters for the selected ink jet based on at least one desired value of said at least one quantifiable performance characteristic, values determined in step (c) for said at least one quantifiable performance characteristic, and said at least two sets of test values;

(e) adjusting the at least primary and secondary operating parameters for the selected ink jet to said calculated desired values;

(f) selecting a second ink jet; and (g) repeating steps (b)–(e).

20. A method according to claim 19, wherein the selected ink jet is a marking element of a print head having an array of M marking elements and said method comprises perforating steps (a) through (e) for each of the M marking elements.

21. A method according to claim 19, further comprising, between steps (d) and (e), the steps of:

assigning a memory location to the selected ink jet;

writing correction data representative of said calculated desired values for the selected ink jet into the memory location assigned to the selected ink jet; and employing the correction data read from said memory location to adjust the at least primary and secondary operating parameters for the selected ink jet.

22. A method according to claim 19, wherein step (b) comprises:

storing a control value;

receiving a drive source signal from a signal source connected to the ink jet printing apparatus;

generating a control signal by processing the drive source signal according to the control value; and controlling one of said primary and secondary operating parameters of the selected ink jet according to said control signal.

23. A method according to claim 22, wherein the controlling step comprises applying said control signal to a driving means for ejectors fluid from the selected ink jet according to said control signal.

24. A method according to claim 23, wherein the receiving step comprises receiving a drive source signal comprising a first pulse having a first transition from a first voltage level to a peak voltage, a flat peak voltage from the end of the first transition, and a second transition from the peak voltage to the first voltage level; and wherein the generating step comprises producing said control signal equal to or less than the drive source signal and producing said control signal at a voltage level corresponding to said control value.

25. A method according to claim 24, wherein the drive source signal further comprises a second pulse of an opposite polarity to the first pulse and having a first transition from said first voltage level to an opposite polarity peak voltage, a flat peak voltage from the end of the first transition, and a second transition from the opposite polarity peak voltage to said first voltage level.

26. Apparatus for marking a print medium, comprising:

a marking element means for applying a marking medium to the print medium in accordance with a performance characteristic of the marking element means, the marking element means having input means for receiving a control signal and said performance characteristic being dependent on said control signal;

a latch means for storing a control value; and switching means for receiving the control value and a pulse signal having at least one transition with a finite slew rate, the switching means producing the control signal as a function of the control value by selectively connecting the pulse signal to said input means and disconnecting the pulse signal from said input means at a time that depends on the control value, whereby amplitude of the control signal depends on the control value and said slew rate.

27. Apparatus according to claim 26, wherein the switching means produces said control signal having an amplitude equal to or less than an amplitude of the pulse signal and having an amplitude representative of the control value.

28. Apparatus according to claim 26, wherein said switching means includes at least a first FET and a first diode attached across the drain and source of the first FET.

29. Apparatus for marking a print medium, comprising:

a marking element means for applying a marking medium to the print medium in accordance with a performance characteristic of the marking element means, the marking element means having input means for receiving a control signal from control means connected to the apparatus for controlling the apparatus said performance characteristic being dependent on said control signal; and switching means for receiving at least one input pulse signal and a control value and producing the control signal by selectively connecting the at least one input signal to said input means and disconnecting the at least one input signal from said input means according to the control value, wherein the switching means produces said control signal having an amplitude equal to or less than an amplitude of the at least one input signal and having an amplitude representative of the control value, and the switching means includes a time function controller which determines the control signal amplitude by the time of disconnection of the at least one input signal.

30. An apparatus according to claim 29 wherein the time function controller is operative to enable and disable the switching means.

31. Apparatus for marking a print medium, comprising a. a source of ink coloring agent to apply to the print medium;

b. an ink jet print head having a plurality of ink jets through which the ink coloring agent is propelled to be applied to the print medium;

c. driving means connected to the print head for driving the ink coloring agent from the plurality of ink jets, the driving means including a control signal for each of the plurality of ink jets, different ones of the plurality of ink jets being driven at different control signal amplitudes;

d. control means for controlling the plurality of ink jets, the control means receiving at least one common drive source signal from a signal source connected to the apparatus, said control means having a memory location for each of the plurality of ink jets, the memory location containing a control value representing a control signal amplitude corresponding to each individual ink jet;

e. connecting means for connecting each one of the control signals to the at least one common drive source signal for a period of time which is determined by the control value within the memory location of the control means for each of the plurality of ink jets; and f. generating means for generating control signal amplitudes less than or equal to an amplitude of the at least one common drive source signal.

32. The apparatus according to claim 31 further comprising means for connecting the control signals to the at least one common drive source signal includes means for disconnections the control signals from the at least one common drive source signal, the control signals having a sufficiently capacitive load to substantially maintain voltages present at times of disconnection of the control signals.

33. Apparatus for marking a print medium, comprising a. a source of ink coloring agent to apply to the print medium;

b. an ink jet print head having a plurality of ink jets through which the ink coloring agent is propelled to be applied to the print medium;

c. driving means connected to the print head for driving the ink coloring agent from the plurality of ink jets, the driving means including a control signal for each of the plurality of ink jets, different ones of the plurality of ink jets being driven at different control signal amplitudes; and d. control means for controlling the plurality of ink jets said control means receiving at least one common drive source signal from a signal source Connected to the apparatus, said control means having a memory location for each of the plurality of ink jets, the memory location containing a control value representing the control signal amplitude value corresponding to each individual jet; and e. generating means for generating control signal amplitudes less than or equal to an amplitude of the at least one common drive source signal.

34. Apparatus for marking a print medium, comprising a. a source of ink coloring agent to apply to the print medium;

b. an ink jet print head having a plurality of ink jets through which the ink coloring agent is propelled to be applied to the print medium;

c. control means coupled to the print head for controlling the plurality of ink jets;

d. transducer means coupled to the print head for driving the ink coloring agent from the plurality of ink jets in response to control signals from the control means for the plurality of ink jets respectively;

e. a signal source coupled to the print head for providing a drive signal having a magnitude that varies with time during a drive interval;

f. memory means coupled to the control means for storing a control value for each jet; and g. switching means interposed between the signal source and the transducer means and responsive to the control value to connect the signal source to the transducer means during an initial part of said drive interval and to disconnect the signal source from the transducer means at a time during said drive interval that depends on said control value, whereby the magnitude of the control signal that is applied to the transducer means depends on said control value.

35. Apparatus according to claim 34, wherein the plurality of ink jets is composed of at least first and second sets of ink jets and each set of ink jets is composed of at least two ink jets, the signal source provides at least first and second common drive signals, the switching means is composed of at least first and second switch members associated with the first and second sets of ink jets respectively, and the first and second switch members receive, respectively, the first and second common drive signals from the signal source.

36. A method of normalizing performance of each ink jet of a multiple-jet-array print head comprising the steps of:

(a) receiving setup information from a controller designating a jet of the multiple-jet-array print head to normalize, a desired level of performance for the designated jet, and set levels for testing the designated jet;

(b) allocating areas of a print medium upon which to place test images representative of the designated jet tested at each set level;

(c) loading one of the designated set levels into a control means for controlling each ink jet of the multiple-jet array print head;

(d) receiving a drive source signal comprising a series of ejection cycles wherein each ejection cycle has a positive pulse of a given positive amplitude followed by a negative pulse of a given negative amplitude;

(e) generating a control signal equal to the drive source signal if the magnitude of the drive source signal is less than or equal to said set level of the control means and generating a control signal by clipping the magnitude of the drive source signal at a magnitude representative of said set level of the control means if the magnitude of the drive source signal is greater than said set level of the control means;

(f) applying the control signal to a piezoelectric acoustic driving means for driving the diaphragm of an ink jet cavity of the designated ink jet and displacing the diaphragm relative to the ink jet cavity in proportion to the amplitude of the control signal so as to eject ink droplets out of an orifice of the designated ink jet onto a print medium, wherein the size and ejection velocity of each ink droplet produced by the designated ink jet is representative of the diaphragm displacement as produced by the control signal;

(g) moving the designated ink jet along an X-axis relative to a plane of the printing medium while the ink droplets are being ejected onto the print medium;

(h) moving the print medium along a Y-axis perpendicular to said X-axis relative to the designated ink jet at particular times between predetermined droplet ejections;

(i) controlling said jet movement along the X-axis and said print medium movement along the Y-axis during of ink droplet ejections for producing the test image on said designated area of the print medium representative of said designated ink jet tested at said set level of the control means;

(j) performing steps (d)–(i) for each of the other set levels for the designated jet;

(k) repeating steps (a)–(j) for each other jet of the multiple-jet-array print head;

(l) illuminating each test image produced on the print medium and determining an average reflected light from each test image in proportion to said incident light;

(m) calculating a color density according to the average reflected light for each one of the test images;

(n) determining a mathematical polynomial relationship between the calculated color densities and respective known set levels for each jet of the multiple-jet-array, wherein the polynomial used for said mathematical relationship has an order less than the number of set levels for each jet;

(o) extracting an optimum set level for each jet of the multiple-jet-array print head by using the respective mathematical relationship, substituting a desired color density representative of said designated desired level of performance, and finding the optimum set level which solves the mathematical relationship;

(p) assigning locations of a memory means to each jet of the multiple-jet-array print head;

(q) writing correction data representative of the optimum set level of each jet of the multiple-jet-array print head into respective locations of the memory means; and (r) subsequently reading the correction data and loading a correction value representative of said correction data into the respective control means of each jet of the multiple-jet-array print head, so that thereafter each jet will perform at substantially the desired level of performance.

37. Apparatus for marking a print medium, comprising:

a. a source of ink coloring agent to apply to the print medium;

b. an ink jet print head having a plurality of ink jets through which the ink coloring agent is propelled to be applied to the print medium;

c. driving means connected to the print head for driving the ink coloring agent from the plurality of ink jets, the driving means having a drive output terminal for each ink jet and including:

i. a drive signal source for generating a common drive signal, ii. a control means for controlling the plurality of ink jets that receives the common drive signal and generates individual jet control signals for the ink jets respectively at the drive output terminals, the control means having a memory that stores a control value for each of said ink jets and a switch for each jet, each switch being responsive to the control value for the respective jet for providing the jet control signal based on the common drive signal, and wherein peak amplitude of the jet control signal depends on the control value, whereby the jet control signals for different jets can be of different peak amplitude.

38. Apparatus according to claim 37, wherein the common drive signal is a pulse signal having at least one transition with a finite slew rate, and the switch produces the jet control signal for a given jet by selectively connecting the pulse signal to the drive output terminal for that jet and disconnecting the pulse signal from the drive output terminal at a time that depends on the control value for the given jet, whereby the peak amplitude of the jet control signal depends on the control value and said slew rate.

* * * * *

UNITED STATES PATENT AND TRADEMARK OFFICE

CERTIFICATE OF CORRECTION

PATENT NO. : 5,502,468

DATED : March 26, 1996

INVENTOR(S) : David L. Knierim

It is certified that error appears in the above-identified patent and that said Letters Patent is hereby corrected as shown below:

In Column 11, line 66, delete "ejectors" and insert -- ejecting --.

Signed and Sealed this

Fifth Day of November, 1996

*Attest:*

Bruce Lehman

BRUCE LEHMAN

*Attesting Officer*

*Commissioner of Patents and Trademarks*